US008338070B2

(12) United States Patent
Mang et al.

(10) Patent No.: US 8,338,070 B2
(45) Date of Patent: Dec. 25, 2012

(54) CONTINUOUS PROCESS FOR PRODUCING TONER USING AN OSCILLATORY FLOW CONTINUOUS REACTOR

(75) Inventors: Mark E. Mang, Rochester, NY (US); Grazyna Kmiecik-Lawrynowicz, Fairport, NY (US); Eugene F. Young, Rochester, NY (US); Maura A. Sweeney, Irondequoit, NY (US)

(73) Assignee: Xerox Corporation, Norwalk, CT (US)

( * ) Notice: Subject to any disclaimer, the term of this patent is extended or adjusted under 35 U.S.C. 154(b) by 234 days.

(21) Appl. No.: 12/839,698

(22) Filed: Jul. 20, 2010

(65) Prior Publication Data

US 2012/0021351 A1 Jan. 26, 2012

(51) Int. Cl.
*G03G 5/00* (2006.01)

(52) U.S. Cl. ..... 430/137.14; 430/137.1

(58) Field of Classification Search ..... 430/137.1, 430/137.14

See application file for complete search history.

(56) References Cited

U.S. PATENT DOCUMENTS 6,114,415 A * 9/2000 Bertelo et al. ..... 523/335
7,507,517 B2 * 3/2009 Wolfe et al. ..... 430/137.14

OTHER PUBLICATIONS

"Operation and Optimization of an Oscillatory Flow Continuous Reactor"; A.P. Harey et al., *Ind Eng. Chem. Res.* 2001, 40, pp. 5371-5377.

"Process Intensification of Biodiesel Production Using a Continuous Oscillatory Flow Reactor"; Adam P. Harvey et al., *Journal of Chemical Technology and Biotechnology* 2003, 78, pp. 338-341.

* cited by examiner

*Primary Examiner* — Stewart Fraser
(74) *Attorney, Agent, or Firm* — MDIP LLC

(57) ABSTRACT

The present disclosure provides for oscillatory flow continuous reactors suitable for use in forming emulsion aggregation toners. The reactor may include at least one receptacle being a flexible, tubular member. The reactor may also include a plurality of baffles disposed, at spaced apart intervals, along an interior space of the tubular member, each of the plurality of baffles including one or more orifices. Additionally, one or more fluids may flow through the tubular member. The oscillatory flow continuous reactor may be used in an emulsion aggregation process to produce toner particles.

20 Claims, 3 Drawing Sheets

CONTINUOUS PROCESS FOR PRODUCING TONER USING AN OSCILLATORY FLOW CONTINUOUS REACTOR

BACKGROUND

The present disclosure relates to toners and processes useful in providing toners suitable for electrophotographic apparatuses.

Numerous processes are within the purview of those skilled in the art for the preparation of toners. Emulsion aggregation (EA) is one such method. These toners are within the purview of those skilled in the art and toners may be formed by aggregating a colorant with a resin formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Toner systems normally fall into two classes: two component systems, in which the developer material includes magnetic carrier granules having toner particles adhering triboelectrically thereto; and single component development systems (SCD), which may use only toner. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system.

Charge control agents may be utilized to enhance triboelectric charging. Charge control agents may include organic salts or complexes of large organic molecules. Such agents may be applied to toner particle surfaces by a blending process. Such charge control agents may be used in small amounts of from about 0.01 weight percent to about 5 weight percent of the toner to control both the polarity of charge on a toner and the distribution of charge on a toner. Although the amount of charge control agents may be small compared to other components of a toner, charge control agents may be important for triboelectric charging properties of a toner. These triboelectric charging properties, in turn, may impact imaging speed and quality. Examples of charge control agents include those found in EP Patent Application No. 1426830, U.S. Pat. No. 6,652,634, EP Patent Application No. 1383011, U.S. Patent Application Publication No. 2004/0002014, U.S. Patent Application Publication No. 2003/0191263, U.S. Pat. No. 6,221,550, and U.S. Pat. No. 6,165,668, the disclosures of each of which are totally incorporated herein by reference.

Improved methods for producing toner, which decrease the production time and permit excellent control of the charging of toner particles, remain desirable.

SUMMARY

The present disclosure relates to a process for producing toner including providing an oscillatory flow continuous reactor comprising at least one tubular member possessing at least one entry port, at least one outlet port, and a plurality of baffles, the baffles including one or more orifices disposed at spaced apart intervals along an interior space of the tubular member; introducing into the tubular member toner components comprising at least one resin, at least one colorant, and optional wax; aggregating the components to produce toner particles; coalescing the toner particles; and recovering the toner particles from the tubular member, wherein the process is a continuous process.

The present disclosure further relates to a continuous process for producing toner including providing an oscillatory flow continuous reactor comprising at least one tubular member possessing at least one entry port, at least one outlet port, and a plurality of baffles, the baffles including one or more orifices disposed at spaced apart intervals along an interior space of the tubular member; introducing into the tubular member, at different locations along a length of the tubular member, toner components comprising at least one resin, at least one colorant, a wax, and optional charge control agent; aggregating the toner components to produce toner particles; coalescing the toner particles; and recovering the toner particles from the tubular member; wherein the plurality of baffles are configured to provide for independence between mixing of materials and fluid flow through the reactor, and wherein the components of the toner have a residence time in the tubular member of from about 5 minutes to about 180 minutes.

The present disclosure provides for an oscillatory flow continuous reactor. The reactor includes at least one receptacle being a flexible, tubular member. The reactor also includes a plurality of baffles disposed, at spaced apart intervals, along an interior space of the tubular member, each of the plurality of baffles including one or more orifices. Additionally, one or more fluids flow through the tubular member. The oscillatory flow continuous reactor may be used in an emulsion aggregation process to produce toner particles including at least one resin, colorants, and optional additives.

In embodiments, the toner particles may have a volume average particle size of from about 4 microns to about 12 microns, in embodiments from about 5 microns to about 9 microns.

In other embodiments, the emulsion aggregation process may be a continuous process. The tubular member may include at least one entry port and at least one outlet port. Also, the one or more fluids may be injected into the tubular member at different stages and locations along a length of the tubular member. Additionally, the one or more fluids may be maintained in an oscillatory flow within the tubular member throughout the entire emulsion aggregation process.

In other embodiments, the oscillatory flow continuous reactor may further include a central pipe for securing the plurality of baffles. The plurality of baffles may be the same or different with respect to each other. The plurality of baffles may be spaced apart at equal or non-equal distances with respect to each other. The plurality of baffles may be fixed to the tubular member or movable relative to the tubular member. The plurality of baffles may be oscillating rings and may be configured to provide for independence between mixing of materials and fluid flow through the reactor in order to allow for residence times of from about 5 minutes to about 180 minutes, or from about 10 minutes to about 150 minutes. Additionally, an oscillatory fluid motion of the one or more fluids may be superimposed on an entire volume within the tubular member.

In other embodiments, a plurality of oscillatory flow continuous reactors may be used in a serial manner. Also, a first oscillatory flow continuous reactor of the plurality of oscillatory flow continuous reactors may handle aggregation and a second oscillatory flow continuous reactor of the plurality of oscillatory flow continuous reactors may handle coalescence.

In other embodiments, the first oscillatory flow continuous reactor may be connected to the second oscillatory flow continuous reactor via a connecting member, the connecting member configured to enable pH adjustment of the one or more fluids.

In other embodiments, a pH adjustment of the one or more fluids may be executed at an entry port of the tubular member and in other embodiments a pH adjustment of the one or more fluids may be executed at an outlet port of the tubular member.

BRIEF DESCRIPTION OF THE DRAWINGS

Various embodiments of the present disclosure will be described herein below with reference to the figures wherein.

DETAILED DESCRIPTION OF EMBODIMENTS

Figure 1:
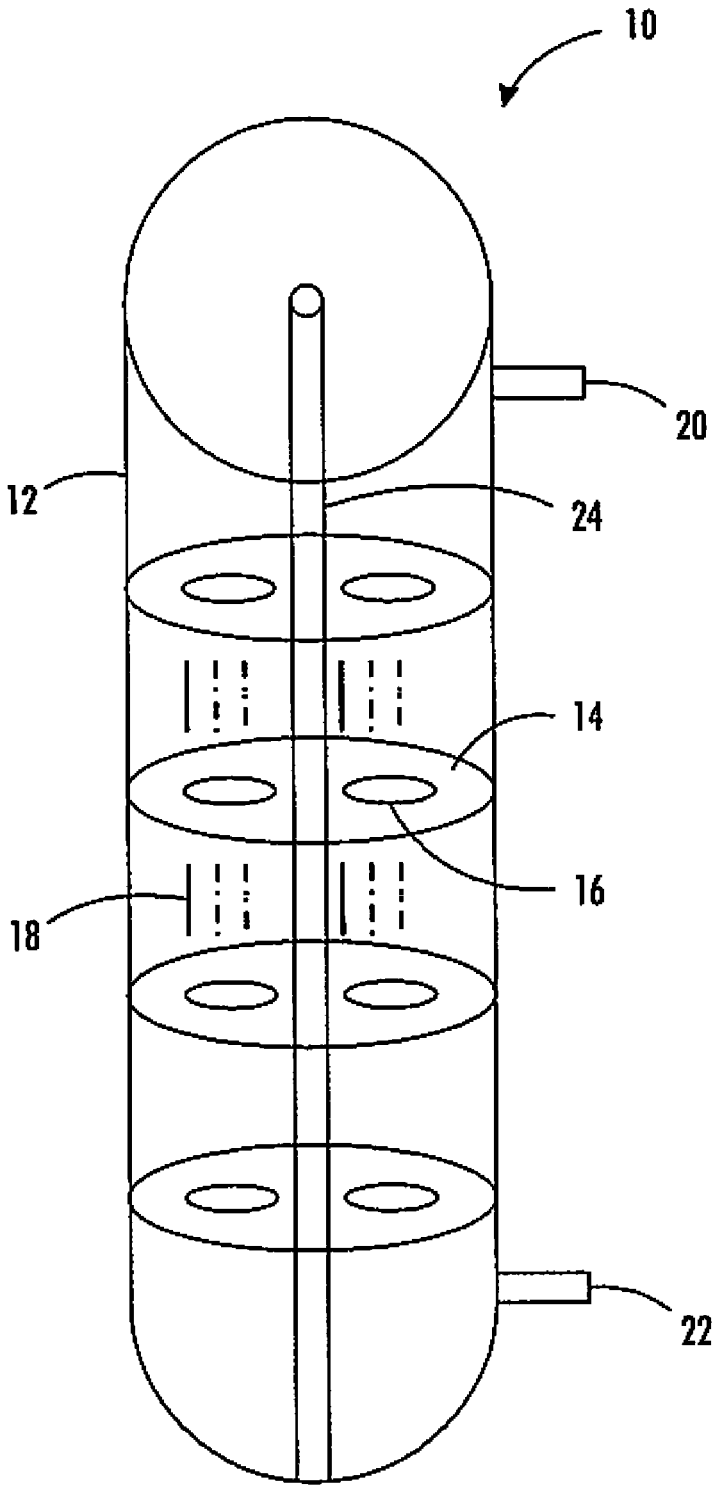
FIG. 1 schematically shows an oscillatory flow continuous reactor, in accordance with a first embodiment of the present disclosure.

The present disclosure provides toners and processes for the continuous preparation of toner particles by means of an emulsion aggregation process.

In embodiments, toners of the present disclosure may be prepared by combining a resin and colorant, and optionally, an optional wax, optional charge control agent, optional surface additives, and other optional additives. While the resin may be prepared by any method within the purview of those skilled in the art, in embodiments the resin may be prepared by emulsion polymerization methods, including semi-continuous emulsion polymerization, and the toner may include emulsion aggregation toners. Emulsion aggregation involves aggregation of both submicron latex and pigment particles into toner size particles having a volume average diameter of from about 4 microns to about 12 microns, in embodiments from about 5 microns to about 9 microns.

Resin

Any monomer suitable for preparing a latex for use in a toner may be utilized. As noted above, in embodiments the toner may be produced by emulsion aggregation. Suitable monomers useful in forming a latex polymer emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the latex polymer may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In addition, polyester resins which may be used include those obtained from the reaction products of bisphenol A and propylene oxide or propylene carbonate, as well as the polyesters obtained by reacting those reaction products with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol.

In embodiments, a poly(styrene-butyl acrylate) may be utilized as the latex polymer. The glass transition temperature of this latex, which in embodiments may be used to form a toner of the present disclosure, may be from about 35° C. to about 75° C., in embodiments from about 40° C. to about 60° C.

Surfactants

In embodiments, the latex may be prepared in an aqueous phase containing a surfactant or co-surfactant. Surfactants which may be utilized with the polymer to form a latex dispersion can be ionic or nonionic surfactants in an amount to provide a dispersion of from about 10 to about 60 weight percent solids, in embodiments of from about 30 to about 50 weight percent solids. The latex dispersion thus formed may be then charged into a reactor for aggregation and the formation of toner particles.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxylethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

Initiators

In embodiments initiators may be added for formation of the latex polymer. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine) dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane] dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis {2-[1-(2-hydroxyethyl)-2-imidazolin-2-yl]propane}dihydrochloride, combinations thereof, and the like.

Initiators can be added in suitable amounts, such as from about 0.1 to about 8 weight percent of the monomers, and in embodiments of from about 0.2 to about 5 weight percent of the monomers.

Chain Transfer Agents

In embodiments, chain transfer agents may also be utilized in forming the latex polymer. Suitable chain transfer agents include dodecane thiol, octane thiol, carbon tetrabromide, combinations thereof, and the like, in amounts from about 0.1 to about 10 percent and, in embodiments, from about 0.2 to about 5 percent by weight of monomers, to control the molecular weight properties of the latex polymer when emulsion polymerization is conducted in accordance with the present disclosure.

Stabilizers

In embodiments, it may be advantageous to include a stabilizer when forming the latex polymer and the particles making up the polymer. Suitable stabilizers include monomers having carboxylic acid functionality. Such stabilizers may be of the following formula (I):

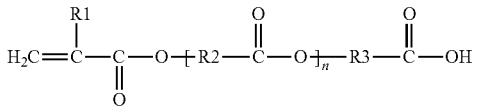

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such stabilizers include beta carboxyethyl acrylate (β-CEA), poly(2-carboxyethyl)acrylate, 2-carboxyethyl methacrylate, combinations thereof, and the like. Other stabilizers which may be utilized include, for example, acrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the stabilizer having carboxylic acid functionality, in embodiments from about 0.5 to about 5 percent by weight of the stabilizer having carboxylic acid functionality.

Where present, the stabilizer may be added in amounts from about 0.01 to about 5 percent by weight of the toner, in embodiments from about 0.05 to about 2 percent by weight of the toner.

Additional stabilizers that may be utilized in the toner formulation processes include bases such as metal hydroxides, including sodium hydroxide, potassium hydroxide, ammonium hydroxide, and optionally combinations thereof. Also useful as a stabilizer are carbonates including sodium carbonate, sodium bicarbonate, calcium carbonate, potassium carbonate, ammonium carbonate, combinations thereof, and the like. In other embodiments, a stabilizer may include a composition containing sodium silicate dissolved in sodium hydroxide.

pH Adjustment Agent

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Wax

Wax dispersions may also be added during formation of a latex polymer in an emulsion aggregation synthesis. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

In embodiments, a suitable wax may include a paraffin wax. Suitable paraffin waxes include, for example, paraffin waxes possessing modified crystalline structures, which may be referred to herein, in embodiments, as a modified paraffin wax. Thus, compared with conventional paraffin waxes, which may have a symmetrical distribution of linear carbons and branched carbons, the modified paraffin waxes of the present disclosure may possess branched carbons in an amount of from about 1% to about 20% of the wax, in embodiments from about 8% to about 16% of the wax, with linear carbons present in an in amount of from about 80% to about 99% of the wax, in embodiments from about 84% to about 92% of the wax.

In addition, the isomers, i.e., branched carbons, present in such modified paraffin waxes may have a number average molecular weight (Mn), of from about 520 to about 600, in embodiments from about 550 to about 570, in embodiments about 560. The linear carbons, sometimes referred to herein, in embodiments, as normals, present in such waxes may have a Mn of from about 505 to about 530, in embodiments from about 512 to about 525, in embodiments about 518. The weight average molecular weight (Mw) of the branched carbons in the modified paraffin waxes may be from about 530 to about 580, in embodiments from about 555 to about 575, and the Mw of the linear carbons in the modified paraffin waxes may be from about 480 to about 550, in embodiments from about 515 to about 535.

For the branched carbons, the weight average molecular weight (Mw) of the modified paraffin waxes may demonstrate a number of carbon atoms of from about 31 to about 59 carbon atoms, in embodiments from about 34 to about 50 carbon atoms, with a peak at about 41 carbon atoms, and for the linear carbons, the Mw may demonstrate a number of carbon atoms of from about 24 to about 54 carbon atoms, in embodiments from about 30 to about 50 carbon atoms, with a peak at about 36 carbon atoms.

The modified paraffin wax may be present in an amount of from about 3% by weight to about 15% by weight of the toner, in embodiments from about from about 6% by weight to about 10% by weight of the toner, in embodiments about 8% by weight of the toner.

Colorants

The latex particles may be added to a colorant dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. In embodiments, the surfactant may be ionic and may be from about 1 to about 25 percent by weight, and in embodiments from about 4 to about 15 percent by weight, of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or combinations thereof. In embodiments a pigment may be utilized. As used herein, a pigment includes a material that changes the color of light it reflects as the result of selective color absorption. In embodiments, in contrast with a dye which may be generally applied in an aqueous solution, a pigment generally is insoluble. For example, while a dye may be soluble in the carrying vehicle (the binder), a pigment may be insoluble in the carrying vehicle.

In embodiments wherein the colorant is a pigment, the pigment may be, for example, carbon black, phthalocyanines, quinacridones, red, green, orange, brown, violet, yellow, fluorescent colorants including RHODAMINE B™ type, and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido)phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 18 weight percent of the toner.

In embodiments, colorant examples include Pigment Blue 15:3 (sometimes referred to herein, in embodiments, as PB 15:3 cyan pigment) having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant. Pigment Red 122 (sometimes referred to herein as PR-122) has been widely used in the pigmentation of toners, plastics, ink, and coatings, due to its unique magenta shade.

Aggregating Agents

In embodiments, an aggregating agent may be added during or prior to aggregating the latex, wax, optional additives, and the aqueous colorant dispersion. Examples of suitable aggregating agents include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. In embodiments, suitable aggregating agents include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid.

In embodiments, a suitable aggregating agent includes PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

The resulting blend of latex, optionally in a dispersion, optional colorant dispersion, wax, and aggregating agent, may then be stirred and heated to a temperature around the Tg of the latex, in embodiments from about 30° C. to about 70° C., in embodiments of from about 40° C. to about 65° C., for a period of time from about 0.2 hours to about 6 hours, in embodiments from about 0.3 hours to about 5 hours, resulting in toner aggregates of from about 4 microns to about 12 microns in volume average diameter, in embodiments of from about 5 microns to about 9 microns in volume average diameter.

In embodiments, while not required, a shell may be formed on the aggregated particles. Any latex utilized noted above to form the core latex may be utilized to form the shell latex. In embodiments, a styrene-n-butyl acrylate copolymer may be utilized to form the shell latex. In embodiments, the latex utilized to form the shell may have a glass transition temperature of from about 35° C. to about 75° C., in embodiments from about 40° C. to about 70° C.

Where present, a shell latex may be applied by any method within the purview of those skilled in the art, including dipping, spraying, and the like. The shell latex may be applied until the desired final size of the toner particles is achieved, in embodiments from about 3 microns to about 12 microns, in other embodiments from about 4 microns to about 8 microns. In other embodiments, the toner particles may be prepared by in-situ seeded semi-continuous emulsion copolymerization of the latex with the addition of the shell latex once aggregated particles have formed.

In other embodiments, toner particles of the present disclosure may not include a separate shell.

Once the desired final size of the toner particles is achieved, the pH of the mixture may be adjusted with a base to a value of from about 3.5 to about 7, in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

The mixture of latex, optional colorant, and wax may be subsequently coalesced. Coalescing may include stirring and heating at a temperature of from about 80° C. to about 99° C., in embodiments from about 85° C. to about 98° C., for a period of from about 15 minutes to about 6 hours, and in embodiments from about 30 minutes to about 5 hours.

The pH of the mixture may then be lowered to from about 3.5 to about 6, in embodiments from about 3.7 to about 5.5, with, for example, an acid to coalesce the toner aggregates. Suitable acids include, for example, nitric acid, sulfuric acid, hydrochloric acid, citric acid and/or acetic acid. The amount of acid added may be from about 0.1 to about 30 percent by weight of the mixture, in embodiments from about 1 to about 20 percent by weight of the mixture.

The mixture may then be cooled in a cooling or freezing step. Cooling may be at a temperature of from about 20° C. to about 40° C., in embodiments from about 22° C. to about 30° C., over a period of time from about 1 hour to about 8 hours, in embodiments from about 1.5 hours to about 5 hours.

In embodiments, cooling a coalesced toner slurry may be performed by lowering the jacket temperature of the reactor. Alternate methods may include quenching by adding a cooling medium such as, for example, ice, dry ice and the like, to effect rapid cooling to a temperature of from about 20° C. to about 40° C., in embodiments of from about 22° C. to about 30° C.

The toner slurry may then be washed. Washing may be carried out at a pH of from about 7 to about 12, and in embodiments at a pH of from about 9 to about 11. The washing may be at a temperature of from about 30° C. to about 70° C., and in embodiments from about 40° C. to about 67° C. The washing may include filtering and reslurrying a filter cake including toner particles in deionized water (DI water). The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

It is also believed that this technology would be applicable to all emulsion aggregation technologies including toners containing one or more of the following polyester resin, crystalline polyester resin, and/or naturally derived resins. Naturally derived resins include the new class of resins derived from natural and/or renewable sources.

Oscillatory Flow Continuous Reactor

Emulsion aggregation (EA) toners may be conventionally made using large stirred tank reactors in a batch process. The aggregation stage of the toner process may include the following steps. The raw materials may be homogenized to ensure small particles and a homogeneous mixture. Near the completion of homogenization, a flocculent, such as poly aluminum chloride, may be added to encourage the submicron particles to form aggregates. Heat and shear may be applied by the mixer to control the growth rate and particle size. Immediately after the flocculent addition and subsequent heating, the viscosity of the mixture may approach that of a yogurt-like consistency. As the aggregates form into larger particles, the viscosity decreases approaching that of water. The pH may be adjusted to prevent further aggregation. The temperature of the mixture may be increased to begin the coalescence process. This may cause the toner aggregates to become more spherical. Further pH adjustments may be performed to control the rate of particle formation. The entire aggregation/coalescence process may take from about 3 to about 8 hours at pilot scale, up to about 24 hours at manufacturing scale. Unfortunately, conventional types of continuous reactors may be unfeasible due to the size required for such a long reaction.

In accordance with the present disclosure, a continuous reactor known as an oscillatory flow continuous reactor may be used to overcome such difficulties and form emulsion aggregation particles.

In embodiments, the oscillatory flow continuous reactor may include a tube with oscillating rings located therein. The oscillating rings may provide advantages over conventional tube reactors. For example, standard tube reactors may require minimum Reynolds numbers to ensure proper mixing. In fluid mechanics, the Reynolds number, Re, is a dimensionless number that gives a measure of the ratio of inertial forces $$\left(\frac{\rho V^2}{L}\right)$$

to viscous forces $$\left(\frac{\mu V}{L^2}\right)$$

and consequently quantifies the relative importance of these two types of forces for given flow conditions. The Reynolds number may be defined for a number of different situations where a fluid is in relative motion to a surface.

However, by using an oscillatory flow continuous reactor, the oscillating rings may enable mixing to be independent of the net flow, thus allowing for longer residence times. The mixing action of the oscillating rings may also allow the oscillatory flow continuous reactor to provide mixing through a wide range of viscosities.

In general, oscillatory flow reactors (OFR) include a tube fitted with equally spaced orifice baffles. The baffles may move independently from the tube. The reactive material may flow through the tube and an oscillatory fluid motion may be superimposed on the entire volume. This combination results in effective mixing within each interbaffle cavity, as well as the entire length of the oscillatory flow continuous reactor.

FIG. 1 illustrates an example of an OFR configuration of the present disclosure. In FIG. 1, an oscillatory flow reactor 10 is shown. The OFR 10 may include at least one receptacle 12, where the receptacle 12 may be a flexible, tubular member. A plurality of baffles 14 may be disposed, at spaced apart intervals, along an interior space of the tubular member 12. Each of the plurality of baffles 14 may include one or more orifices 16. Additionally, one or more fluids 18 may flow through the tubular member 12. The OFR 10 may be used in an emulsion aggregation process to produce toner particles including at least wax, colorants, resin(s), and charge control agents. The tubular member 12 may also include an entry port 20 and an outlet port 22. Additionally, the emulsion aggregation process may be a continuous process.

The toner particles thus produced may have a volume average particle size from about 4 microns to about 12 microns, in embodiments from about 5 microns to about 9 microns. The one or more fluids 18 may be injected into the tubular member 12 at different stages and locations along a length of the tubular member 12. Additionally, the one or more fluids 18 may be maintained in an oscillatory flow within the tubular member 12 throughout the entire emulsion aggregation process.

The OFR 10 may further include a central pipe 24 for securing the plurality of baffles 14. The plurality of baffles 14 may be the same or different size with respect to each other. The plurality of baffles 14 may be spaced apart at equal or non-equal distances with respect to each other. The plurality of baffles 14 may be fixed to the tubular member 12 or movable relative to the tubular member 12. The plurality of baffles 14 may be oscillating rings and may be configured to provide for independence between mixing of materials and fluid flow through the OFR 10 in order to allow for longer residence times. Additionally, an oscillatory fluid motion of the one or more fluids 18 may be superimposed on an entire volume within the tubular member 12.

Figure 2:
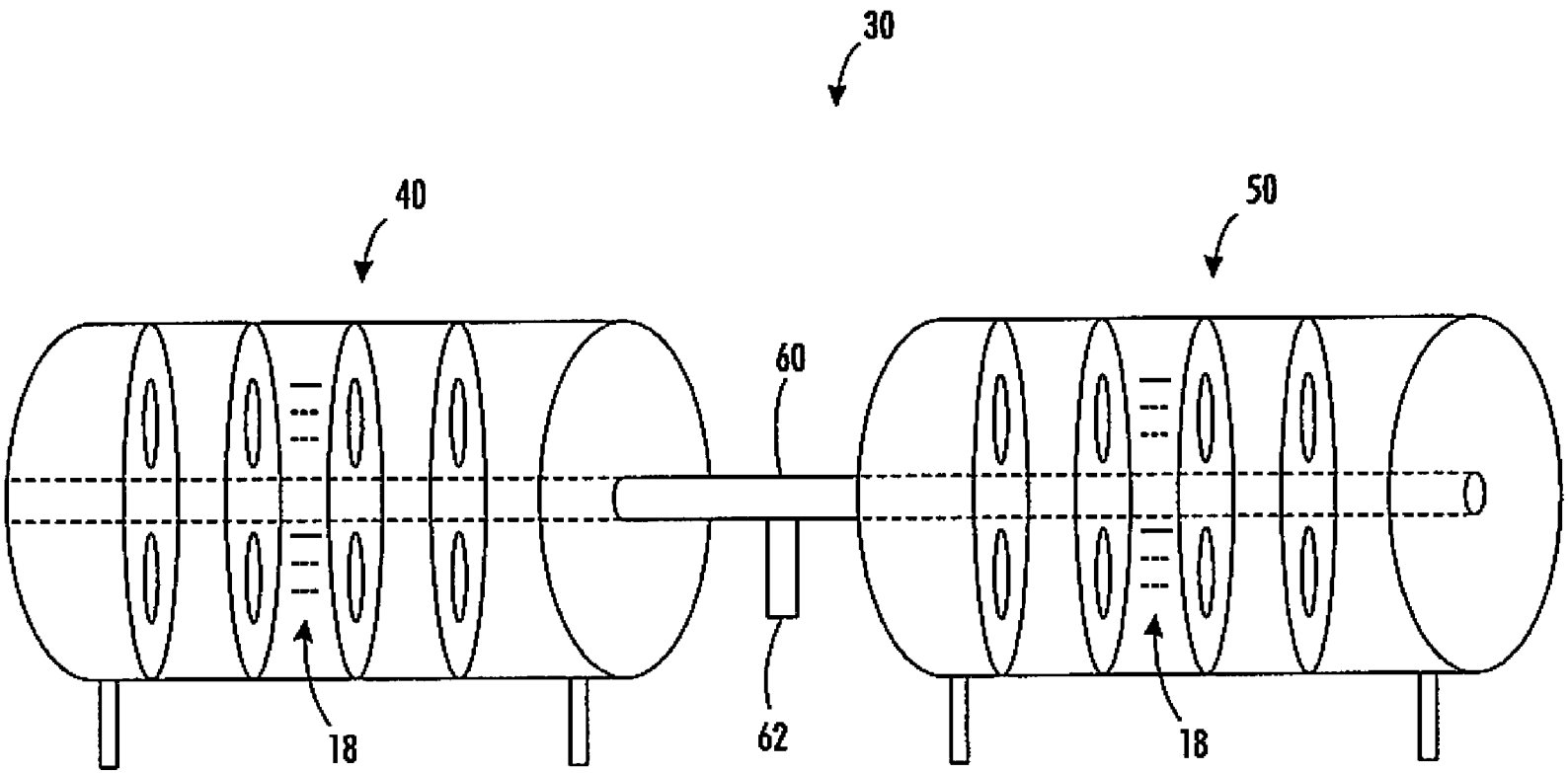
FIG. 2 schematically shows a series of oscillatory flow continuous reactors, in accordance with a second embodiment of the present disclosure.

The plurality of oscillatory flow continuous reactors 30 may be used in a serial manner, as shown in FIG. 2. A first oscillatory flow continuous reactor 40 of the plurality of oscillatory flow continuous reactors 30 may handle aggregation, and a second oscillatory flow continuous reactor 50 of the plurality of oscillatory flow continuous reactors 30 may handle coalescence. In other words, each of the plurality of OFRs 30 may be used for a different purpose and connected to each other in a serial fashion, parallel fashion, or any other manner within the purview of one skilled in the art.

Additionally, the first oscillatory flow continuous reactor 40 may be connected to the second oscillatory flow continuous reactor 50 via a connecting member 60, the connecting member 60 configured to enable pH adjustment of the one or more fluids 18 within the reactors. The connecting member 60 may include its own entry port 62. Moreover, a pH adjustment of the one or more fluids 18 may be executed at an entry port 20 of the tubular member 12 and in other embodiments a pH adjustment of the one or more fluids 18 may be executed at an outlet port 22 of the tubular member 12.

Figure 3:
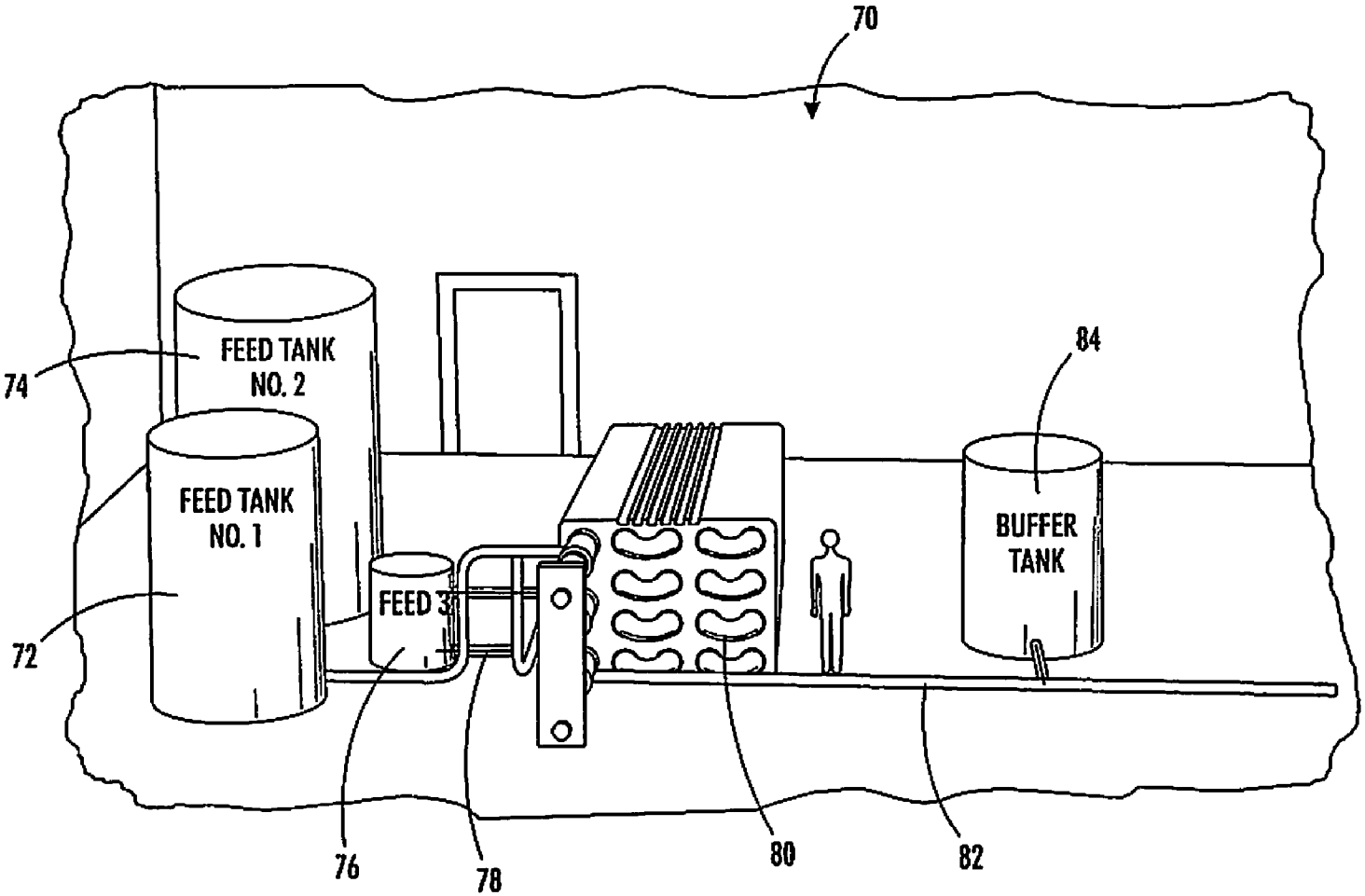
FIG. 3 schematically shows a system for using an oscillatory flow continuous reactor in accordance with the present disclosure.

In FIG. 3, an OFR system 70 is shown. The OFR system 70 may include a plurality of feeds. For example, a first feed 72, a second feed 74, and a third feed 76. Each feed may include a different material to be added to the system 70. For example, the feeds 72, 74, 76 may be at least wax, colorants, resin(s), and/or charge control agents, as described herein. The feeds 72, 74, 76 may be received by the OFR 80 via one or more entry ports 78. The materials may be mixed in the OFR 80. The OFR 80 may then transmit the mixed materials via one or more outlet ports 82. The mixed materials may come into contact with contents of a buffer tank 84 for further emulsion aggregation processing.

An advantage of an OFR 10 is that it may provide a way to perform reactions that require hours in a reactor of greatly reduced L/D ratio. Mixing may be independent of the net flow and there may be no need to maintain a minimum Reynolds number. The result may be the ability to perform the reaction in a reactor of substantially smaller L/D relative to a reactor that requires flow for mixing. With oscillatory flow mixing, the intensity of the mixing may be precisely controlled by adjusting the frequency and amplitude of the plurality of baffles 14.

Relative to large stirred tank reactors, the OFR reactor offers the following advantages. Since a smaller volume is continually processed the heating up and cooling down temperature ramps are more rapid. The reactor may optionally be operated with an internal pressure greater than ambient atmospheric pressure. This allows the coalescence temperature of the toner slurry to be increased to increase the rate of chance of circularity relative to a system operated at atmospheric pressure and the temperature is limited by the boiling point of water.

What is claimed is:

1. A process for producing toner comprising:

providing an oscillatory flow continuous reactor comprising at least one tubular member possessing at least one entry port, at least one outlet port, and a plurality of baffles, the baffles including one or more orifices disposed at spaced apart intervals along an interior space of the tubular member;

introducing into the tubular member toner components comprising at least one resin, at least one colorant, and an optional wax;

aggregating the components to produce toner particles;

coalescing the toner particles; and recovering the coalesced toner particles from the tubular member, wherein the process is a continuous process, and wherein the process does not require maintenance of a minimum Reynolds number.

2. The process according to claim 1, wherein the at least one resin comprises a poly(styrene-butyl acrylate), and wherein the toner particles have a volume average particle size of from about 4 microns to about 12 microns.

3. The process according to claim 1, wherein the toner components are introduced into the tubular member at different locations along a length of the tubular member.

4. The process according to claim 1, wherein the oscillatory flow continuous reactor further includes a means for securing the plurality of baffles.

5. The process according to claim 1, wherein the spaced apart intervals are equidistant.

6. The process according to claim 1, wherein the spaced apart intervals are not equidistant.

7. The process according to claim 1, wherein the plurality of baffles are fixed to the tubular member.

8. The process according to claim 1, wherein the plurality of baffles are movable relative to the tubular member.

9. The process according to claim 1, wherein the plurality of baffles are oscillating rings.

10. The process according to claim 1, wherein the plurality of baffles are configured to provide for independence between mixing of materials and fluid flow through the reactor, and wherein the components of the toner have a residence time in the tubular member of from about 5 minutes to about 180 minutes.

11. The process according to claim 1, wherein a plurality of oscillatory flow continuous reactors are used in a serial manner.

12. The process according to claim 11, wherein a first oscillatory flow continuous reactor is connected to a second oscillatory flow continuous reactor via a connecting member, and wherein aggregating the toner particles occurs in the first oscillatory flow continuous reactor, and coalescing the toner particles occurs in the second oscillatory flow continuous reactor.

13. A continuous process for producing toner comprising:

providing an oscillatory flow continuous reactor comprising at least one tubular member possessing at least one entry port, at least one outlet port, and a plurality of baffles, the baffles including one or more orifices disposed at spaced apart intervals along an interior space of the tubular member;

introducing into the tubular member, at different locations along a length of the tubular member, toner components comprising at least one resin, at least one colorant, a wax, and optional charge control agent;

aggregating the toner components to produce toner particles;

coalescing the toner particles; and recovering the coalesced toner particles from the tubular member; wherein the plurality of baffles are configured to provide for independence between mixing of materials and fluid flow through the reactor, wherein the components of the toner have a residence time in the tubular member of from about 5 minutes to about 180 minutes, and wherein the process does not require maintenance of a minimum Reynolds number.

14. The process according to claim 13, wherein the at least one resin comprises at least a poly(styrene-butyl acrylate), and wherein the toner particles have a volume average particle size of from about 4 microns to about 12 microns.

15. The process according to claim 13, wherein the spaced apart intervals are equidistant.

16. The process according to claim 13, wherein the spaced apart intervals are not equidistant.

17. The process according to claim 13, wherein the plurality of baffles are fixed to the tubular member.

18. The process according to claim 13, wherein the plurality of baffles are movable relative to the tubular member.

19. The process according to claim 13, wherein a plurality of oscillatory flow continuous reactors are used in a serial manner.

20. The process according to claim 19, wherein a first oscillatory flow continuous reactor is connected to a second oscillatory flow continuous reactor via a connecting member and wherein the first oscillatory flow continuous reactor of the plurality of oscillatory flow continuous reactors handles aggregation and the second oscillatory flow continuous reactor of the plurality of oscillatory flow continuous reactors handles coalescence.

* * * * *